US007614728B2

(12) United States Patent
Ghisalberti et al.

(10) Patent No.: US 7,614,728 B2
(45) Date of Patent: Nov. 10, 2009

(54) CARTRIDGE FOR FEEDING INK TO AN INK DUCT OF A PRINTING MACHINE AND DEVICE FOR FILLING SAID CARTRIDGE

(75) Inventors: Marcello Ghisalberti, Almenno S. Bartolomeo (IT); Lorenzo Ghisalberti, Stezzano (IT)

(73) Assignee: T.G.C. S.r.l., Grassobbio (Bergamo) (IT)

( * ) Notice: Subject to any disclaimer, the term of this patent is extended or adjusted under 35 U.S.C. 154(b) by 513 days.

(21) Appl. No.: 11/119,753

(22) Filed: May 3, 2005

(65) Prior Publication Data

US 2005/0243150 A1 Nov. 3, 2005

(30) Foreign Application Priority Data

May 3, 2004 (IT) ..... MI2004A0883

(51) Int. Cl.
*B41J 2/175* (2006.01)

(52) U.S. Cl. ..... 347/84

(58) Field of Classification Search ..... 347/84, 347/85; 141/2, 18

See application file for complete search history.

(56) References Cited

U.S. PATENT DOCUMENTS 3,720,473 A * 3/1973 Nakata ..... 401/40
3,896,723 A 7/1975 Farrow et al.
5,101,219 A * 3/1992 Gerber et al. ..... 346/140.1
5,799,578 A * 9/1998 Junghans ..... 101/348
5,921,181 A * 7/1999 Ritter ..... 101/366
5,974,971 A * 11/1999 Moller et al. ..... 101/366
5,992,695 A 11/1999 Start

FOREIGN PATENT DOCUMENTS

DE 19953324 5/2001
DE 20317054 3/2004
EP 0 716 923 A1 6/1996
JP 11-20179 * 1/1999

* cited by examiner

*Primary Examiner*—Anh T. N. Vo
(74) *Attorney, Agent, or Firm*—Young & Thompson

(57) ABSTRACT

The cartridge (1) for feeding ink to an ink duct of a printing machine comprises, for containing ink, a hollow casing (2) presenting a base (4) provided with an ink dispensing valve (4*a*) and a piston (5) slidable within the hollow casing (2) to cause the ink to be dispensed by the dispensing valve (4*a*). The piston (5) presents a non-return valve (7) for feeding ink into the hollow casing (2), to enable the cartridge to be recharged. The cartridge filling device (30) comprises a housing (32) for the cartridge (1) and a filling head (33) associable with the piston and supported by actuator means (34) for its movement. The head (33) is connected to an ink feed pump (35) and presents at least one opening element (37) for opening the non-return valve (7) of the piston (5), to deliver ink into the cartridge (1).

20 Claims, 4 Drawing Sheets

1
18
2
9
7
10
8
5
6
11
3
4
4a 5
8
9
7
10
14
17
13
20
15
11
16

30
34

49
50
33
31
F3
18
5
1
F2
4
32

CARTRIDGE FOR FEEDING INK TO AN INK DUCT OF A PRINTING MACHINE AND DEVICE FOR FILLING SAID CARTRIDGE

The present invention relates to a cartridge for feeding ink to an ink duct of a printing machine and to a device for filling said cartridge.

Printing machines are known to be used for printing typographical characters and/or designs on paper, cardboard, tinplate, plastic or other supports, to form newspapers, magazines, boxes, etc.

Printing machines usually comprise an entry station from which the support (such as paper) is withdrawn and, in series with the entry station, a plurality of printing stations arranged in succession; in each printing station an ink of a predetermined colour is applied to the support (possibly superimposed on a previously applied colour), to form a representation of characters and/or designs in four-colour, in six-colour or as required by the particular production process.

In each printing station the particular ink is supplied by an ink duct which consists substantially of an inclined plate presenting two containing sides in contact with a roller; the ink passes from this roller to a plurality of other rollers of the same printing station, to be applied to the support in the correct manner and quantity.

The ink which has left the ink duct (to be applied to the support) is periodically replenished, to enable the printing machine to operate correctly.

The ink in the ink duct is replenished either manually by inserting the ink into the ink duct by means of a spatula, or automatically.

In this latter method the ink is fed automatically into the ink duct by pumps which dip into large drums, of a size which can reach 200 kilograms.

In other methods the ink is replenished by ink cartridges which translate along the ink duct and release the ink only into those positions of the ink duct where this is absent or in too small a quantity; these positions are determined by a sensor.

The cartridges are currently pre-packaged for once-only use; in practice, the printer purchases one or more cartridges to replace a cartridge in the machine when nearly empty.

The replaced cartridges (which are removed from the machine) are then disposed of by the printer and/or by the cartridge supplier.

These traditional cartridges clearly present a considerable environmental impact as the cartridges to be disposed of are generally of plastic or cardboard and are soiled with ink.

The need to replace empty cartridges has as a direct consequence both the high cost of purchasing a number of new cartridges and the high cost of disposing of the empty cartridges.

The technical aim of the present invention is therefore to provide a cartridge for feeding ink to an ink duct of a printing machine and a device for filling said cartridge, by which the stated technical drawbacks of the known are eliminated.

Within the scope of this technical aim, an object of the invention is to provide a cartridge presenting limited environmental impact as it limits the number of cartridges to be disposed of.

A further object of the invention is to provide a cartridge and a filling device by which the cost of acquiring new cartridges and the cost of disposing of empty ink cartridges are limited.

The technical aim together with these and further objects are attained according to the invention by providing a cartridge for feeding ink to an ink duct of a printing machine and a device for filling said cartridge in accordance with the accompanying claims.

Further characteristics and advantages of the invention will be more apparent from the description of a preferred but non-exclusive embodiment of the cartridge for feeding ink to an ink duct of a printing machine and the device for filling said cartridge of the invention, illustrated by way of non-limiting example in the accompanying drawings, in which.

Figure 1:
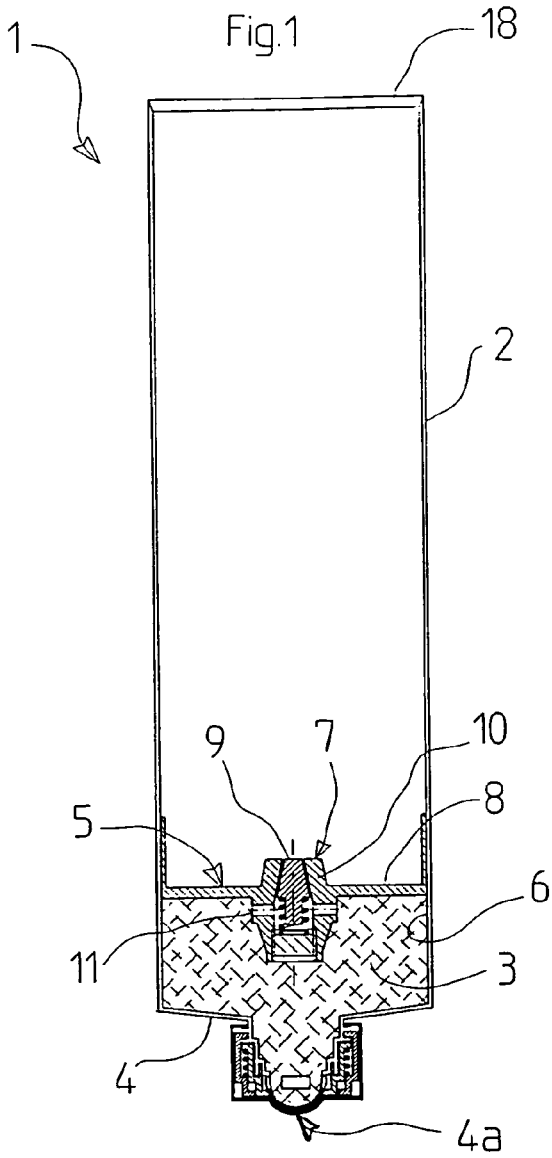
FIG. 1 is a cross-section through a partly empty cartridge of the invention.

Said figures show a cartridge for feeding ink to an ink duct of a printing machine and a device for filling said cartridge.

The cartridge is indicated overall by the reference numeral 1.

The cartridge 1 comprises a cylindrical hollow casing of plastic, cardboard or metal for containing ink (indicated by the reference numeral 3 in the figures) and presenting a base 4 provided with an ink dispensing valve 4*a* which opens or closes depending on whether a pressure is or is not exerted on the ink contained in the cartridge; the dispensing valve 4*a* is advantageously closed by a cap which ensures that it remains closed during filling and storage.

The cartridge 1 also presents a piston 5 slidable within the hollow casing 2 to cause the ink 3 to be dispensed by the dispensing valve 4*a*.

The ink is contained in a chamber 6 defined between the hollow casing 2, the base 4 and the piston 5.

Advantageously the piston presents a non-return valve 7 (or check valve) which feeds ink into the chamber 6 of the hollow casing 2, to enable the cartridge 1 to be refilled.

The non-return valve 7 is positioned in a central position of a front wall 8 of the piston 5.

The non-return valve 7 also suitably presents a portion 9 projecting from the front wall 8 of the piston 5.

As will be apparent hereinafter, said projecting portion 9 enables the valve 7 to be opened when the cartridge 1 is associated with the device for its filling.

The non-return valve 7 comprises a valve body 10 integral with the piston 5; the valve 7 also comprises, in correspondence with a portion of the piston 5 facing the interior of the hollow casing 2 (i.e. towards the chamber 6), a plurality of holes 11 for distributing the ink uniformly inside the chamber 6 of the hollow casing 2.

In the described example the cartridge 1 presents four holes 11 disposed at 90 degrees apart (in the example, two aligned holes are visible, however other arrangements and other than four holes are possible, depending on the density of the ink being used.

Figure 2:
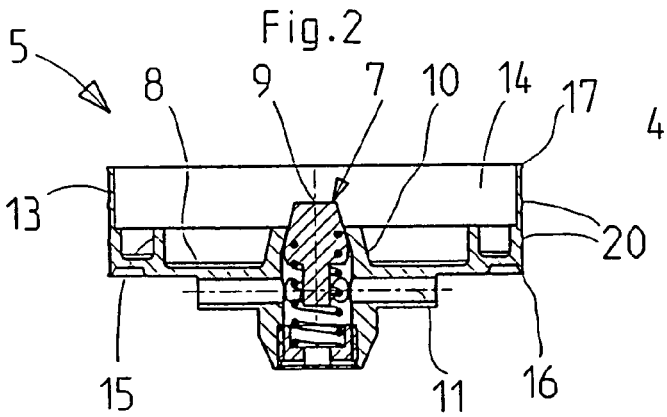
FIG. 2 is an enlarged cross-section through a piston of the cartridge of FIG. 1.

As shown in FIG. 2, the piston 5 presents an annular edge 13 projecting beyond the projection portion 9 of the non-return valve 7, to define an open chamber 14 containing said projecting portion 9 of the valve 7.

The fact of having inserted the projecting portion 9 of the valve 7 into an open chamber 14 enables this portion to be protected and any undesirable accidental opening of the valve 7 to be prevented.

The piston 5 presents one or more first annular stiffening ribs 15 disposed on the front wall 8, and also presents a first scraper 16 to remove ink from the inner wall of the hollow casing 2 when the piston 5 penetrates into the hollow casing 2 during ink dispensing, and a second scraper 17 to remove ink from the inner wall of the hollow casing 2 when the piston 5 moves from the interior of the hollow casing 2 towards an aperture 18 thereof, during ink recharging.

The presence of two scrapers means that the cartridge is efficient after each recharge, by limiting the risk of ink seepage or air entry into the chamber 6 due to incrustations formed on the wall of the hollow casing 2. The cartridge 1 also presents second stiffening ribs 20 disposed on he periphery of the annular edge 13.

The cartridge 1 can be used as a traditional cartridge, i.e. it can be mounted as a traditional cartridge on the ink duct and operate as a traditional cartridge by dispensing ink in correspondence with those portions of the ink duct where ink is lacking.

However, when the cartridge is empty, it does not have to be replaced by a new cartridge but instead can be recharged by filling the chamber 6 with ink using the filling device shown in FIGS. 3-6 and indicated overall therein by the reference numeral 30.

Figure 3:
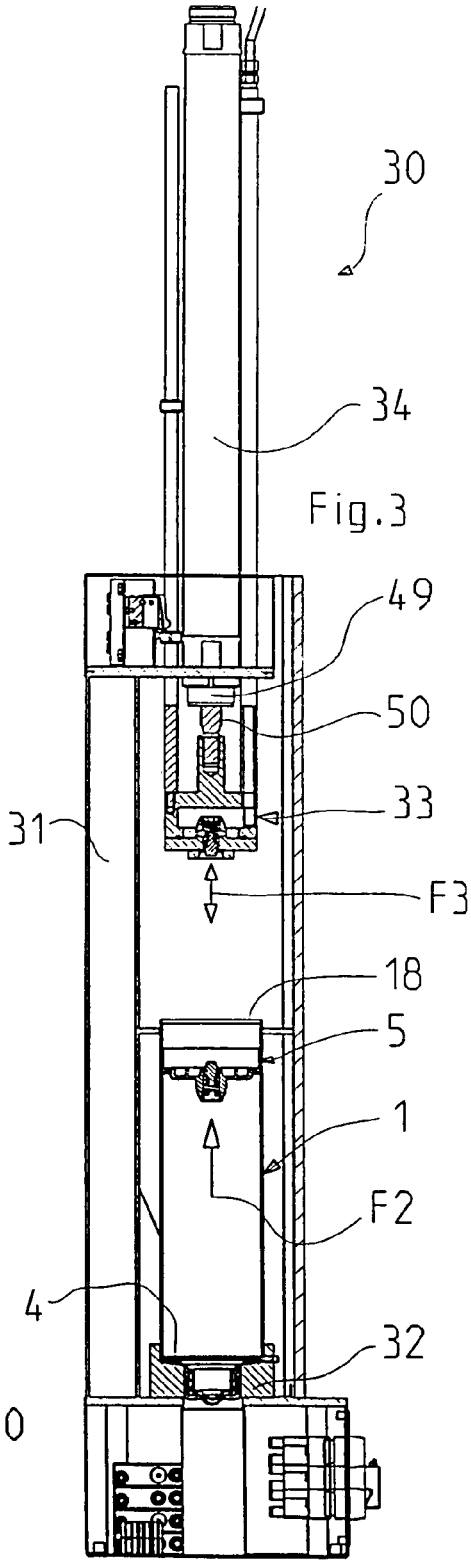
FIG. 3 is a partly sectional view of a device for filling an empty cartridge, in this figure an already filled cartridge being shown associated with the device.

The device 30 comprises a frame 31 presenting a housing 32 for the cartridge 1 to be filled and a filling head 33 supported by actuator means 34 for its movement (as indicated by the arrow F3); the head 33 is supported at that end of the frame 31 opposite that provided with the housing 32; as shown in FIG. 3 the housing 32 is arranged to support the cartridge 1 with its open portion 18 facing the filling head 33 (i.e. upwards), so that the head can penetrate into the hollow casing 2 and move in correspondence with the piston 5, when the cartridge is empty, to recharge it.

The filling head 33 is connected to an ink feed pump 35 (FIG. 6) for supplying the filling device 30 with ink under pressure (pressure of a few bars) to fill the cartridge chamber 6.

The filling head 33 presents an opening element 37 to open the non-return valve 7 of the cartridge piston 5 so that when the filling head 33 is associated with the cartridge piston 5, ink can be delivered into the cartridge 1.

The filling head 33 also presents a non-return valve 38 positioned in a region 39 of the filling head 33 which defines the hydraulic connection between the cartridge piston 5 and the filling ink.

Said non-return valve 38 is positioned in a central position of a wall 40 of the filling head 31 which can be engaged with the piston 5 of the ink cartridge.

Figure 4:
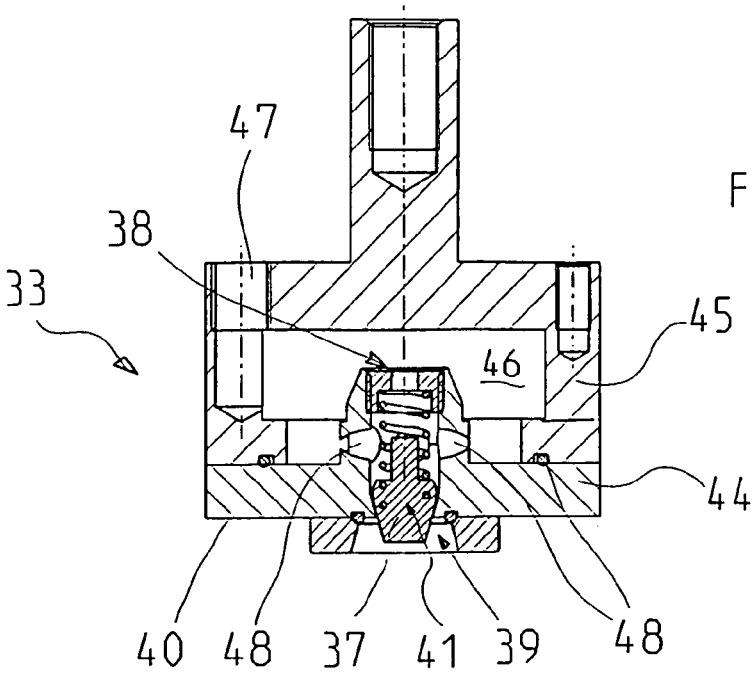
FIG. 4 is a cross-section through a filling head of the device of FIG. 3.
Figure 5:
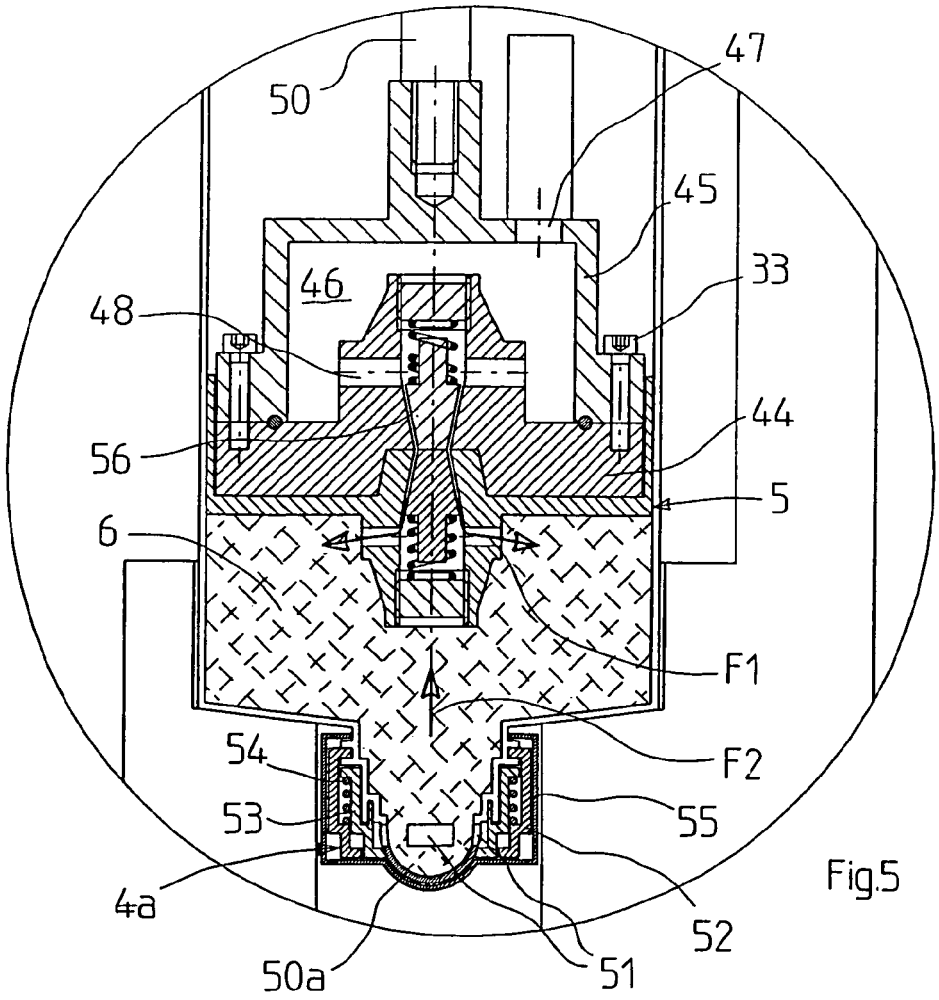
FIG. 5 shows the filling head of the device associated with the cartridge piston, for recharging the cartridge with ink.
Figure 6:
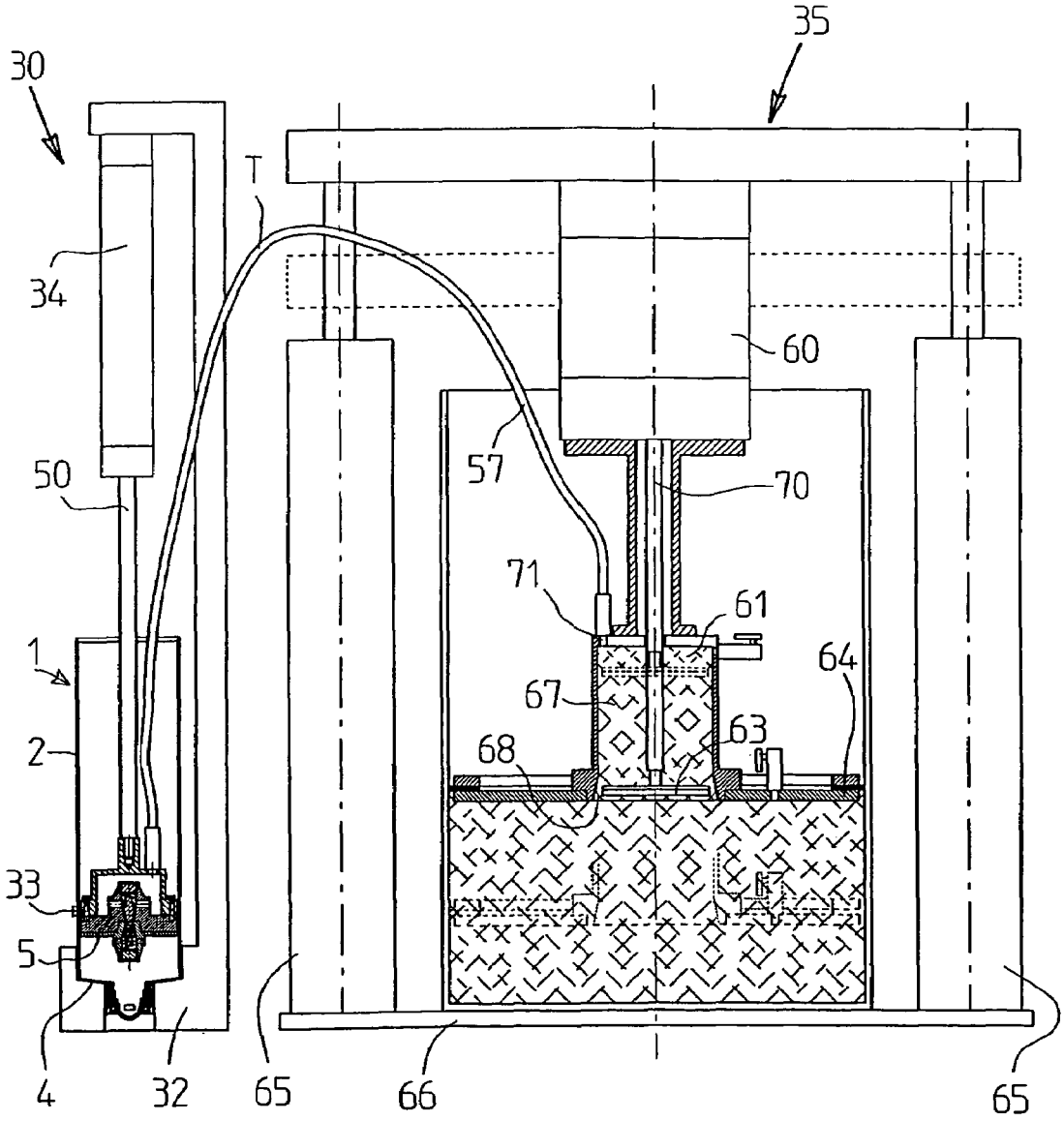
FIG. 6 is a partly sectional view of the device of FIG. 3 associated with a pump for the ink.

As shown in FIGS. 4 and 5, a valving element 41 of the filling head 33 presents a projecting end (when the non-return valve 38 is closed) defining the opening element 37 for the non-return valve 7 of the cartridge piston 5.

Advantageously, the filling head 33 comprises a part 44 supporting the non-return valve 38 and a cap 45 which together with the part 44 defines an inner chamber 46 of the filling head 33 into which a conduit 47 connected to the ink pump 35 and one or more through holes 48 connecting the non-return valve 38 to the internal chamber 46 of the filling head 33 open (in the present example the filling head 33 presents four through holes 48 disposed at 90 degrees apart; in FIG. 4 two of these holes are visible).

The cap 45 is connected to the end of a rod 50 of a double acting pneumatic piston forming the actuator 34.

In a preferred embodiment, the device 30 presents a sensor 49 for measuring the extension of the rod 50 of the pneumatic cylinder 34; this enables the exact ink level in the cartridge to be determined and the recharge to be automatically interrupted when the desired quantity is reached or when the cartridge is full.

Advantageously, this enables a cartridge to be completely filled with a determined type of ink or, in other cases, to be only partly filled with one type of ink if the printing to be done requires only a small quantity of this ink (for example of particular colour or characteristics).

The dispensing valve **4*a* (shown in FIG. 5) comprises a convex central part 50*a* comprising a series of radial holes 51 for exit of the ink from the cartridge, an outer ring 52 fixed to the central part 50*a* and a movable inner ring 53 of circumference close to that of the central part 50*a*, to close the aperture 51**.

Within the space between the outer ring 52 and the inner ring 53 there is an elastic spring 54 (the inner ring moves against this spring); one end of the spring is locked by the radial outer ring 52 to the central part **50*a***.

The spring 54 maintains the inner ring 53 adhering to the central part **50*a* to close the radial holes 51 until a pressure is exerted on the ink in the cartridge to cause the inner ring 53** to advance axially and create an annular channel for ink exit.

FIG. 5 also shows a cap 55 for closing the dispensing valve **4*a***; this is removed when ink is to be dispensed.

The operation of the cartridge filling device of the invention is apparent from that described and illustrated and is essentially as follows.

An empty cartridge is positioned in the housing 32 resting on the base 4 and with the aperture 18 facing upwards and aligned with the filling head 33 (this arrangement is represented in FIG. 3 which shows the cartridge already filled and presenting the piston 5 close to the aperture 18).

The actuator 34 then lowers the filling head 33 to insert it into the hollow casing 2 and bring it in correspondence with the piston 5 (which lies close to the base as the cartridge is empty, as shown in FIG. 5).

When the filling head is brought into contact with the piston, the opening element 37 of the non-return valve 38 presses against the projecting portion 9 of the valve 7 with a pressure such as to open both the non-return valve 7 and the non-return valve 38 while at the same time maintaining the already transferred ink compacted to prevent formation of air bubbles.

The non-return valves 7 and 38 open to define an annular channel indicated by the reference numeral 56 in FIG. 5; this annular channel 56 connects the chamber 46 of the filling head 33 to the chamber 6 of the cartridge 1.

At this point the ink, fed under pressure by the pump 35 through the conduit 57 to the chamber 46 of the head 33, enters the chamber 6 as indicated by the arrows F1 and, by virtue of its pressure, overcomes the resistance of the piston 5 and make it move towards the cartridge aperture 18, as indicated by the arrow F2; in this manner the cartridge can be filled to return it to a condition similar to that of a new cartridge.

According to tests carried out, a cartridge of the invention can be refilled by a device of the invention even one hundred times, with substantial ecological and economic advantages.

The pump 35 comprises a double acting pneumatic cylinder 60 and presents one or, in other examples, two intake or delivery chambers 61 (one in the present example) which cooperate with an ink collection disc 63 to constantly feed the chamber 61, and with a pressing plate 64 which maintains the ink compacted by the action of one or two pneumatic cylinders 65 (two in the present example) which support the entire pump 35, making it translate relative to a base 66.

The double acting pneumatic cylinder 60 is controlled by a system which alternately feeds compressed air into one and the other of its internal compartments, to provide continuous reciprocating movement.

In the single chamber embodiment (shown in FIG. 6) the chamber 61 performs both the intake function and the function of delivering ink to the device 30.

The chamber 61 is cylindrical and presents an end part 68 of increased diameter, so that between the lower end of its wall and the collection disc 63 rigid with a rod 70 of the pneumatic cylinder 60, an annular channel is defined for entry of the ink into this chamber.

During the rising movement of the rod 70 of the cylinder 60, the collection disc 63 adheres to the wall of the chamber 61 and compresses the ink present therein, to cause it to emerge through an upper aperture 71 to which the conduit 57 is connected, this latter being connected to the filling head 33 of the device 30; this conduit is preferably flexible.

In the double chamber variant (not shown), a first lower chamber (shaped as that previously described for the single chamber pump) performs the ink intake function, while a second upper chamber performs the delivery function.

The intake chamber is connected to the delivery chamber via a non-return valve which enables the ink to pass from the intake chamber to the delivery chamber but not vice versa.

In addition, the rod of the pneumatic cylinder (which passes through both the chambers, which are superposed) presents portions of different cross-section.

During the rising movement of the pneumatic cylinder rod, the collection disc compresses the ink present in the intake chamber, making it flow through the non-return valve and into the delivery chamber, where it saturates its capacity.

During the descending movement, the central region of the delivery chamber, firstly occupied by a portion of the pneumatic cylinder rod having a given cross-section, is occupied by a portion of the rod having a greater cross-section, such as to compress the ink present in the delivery chamber and cause it to emerge through a lateral aperture to which the flexible tube connecting to the device 30 is connected.

In this manner a pneumatic-hydraulic pressure multiplier is formed in which the ratio of the double acting pneumatic cylinder cross-section to the cross-section of the hydraulic element formed by the intake and/or delivery chambers represents the pressure ratio RP; this means that by feeding the pneumatic cylinder with air at a pressure P1, the pump generates a pressure P2 corresponding to the product P1×RP.

The use of two chambers with suitably different volumes enables a still higher pressure to be generated, which is very useful if the conduit 57 connected to the device 30 is very long.

Figure 7:
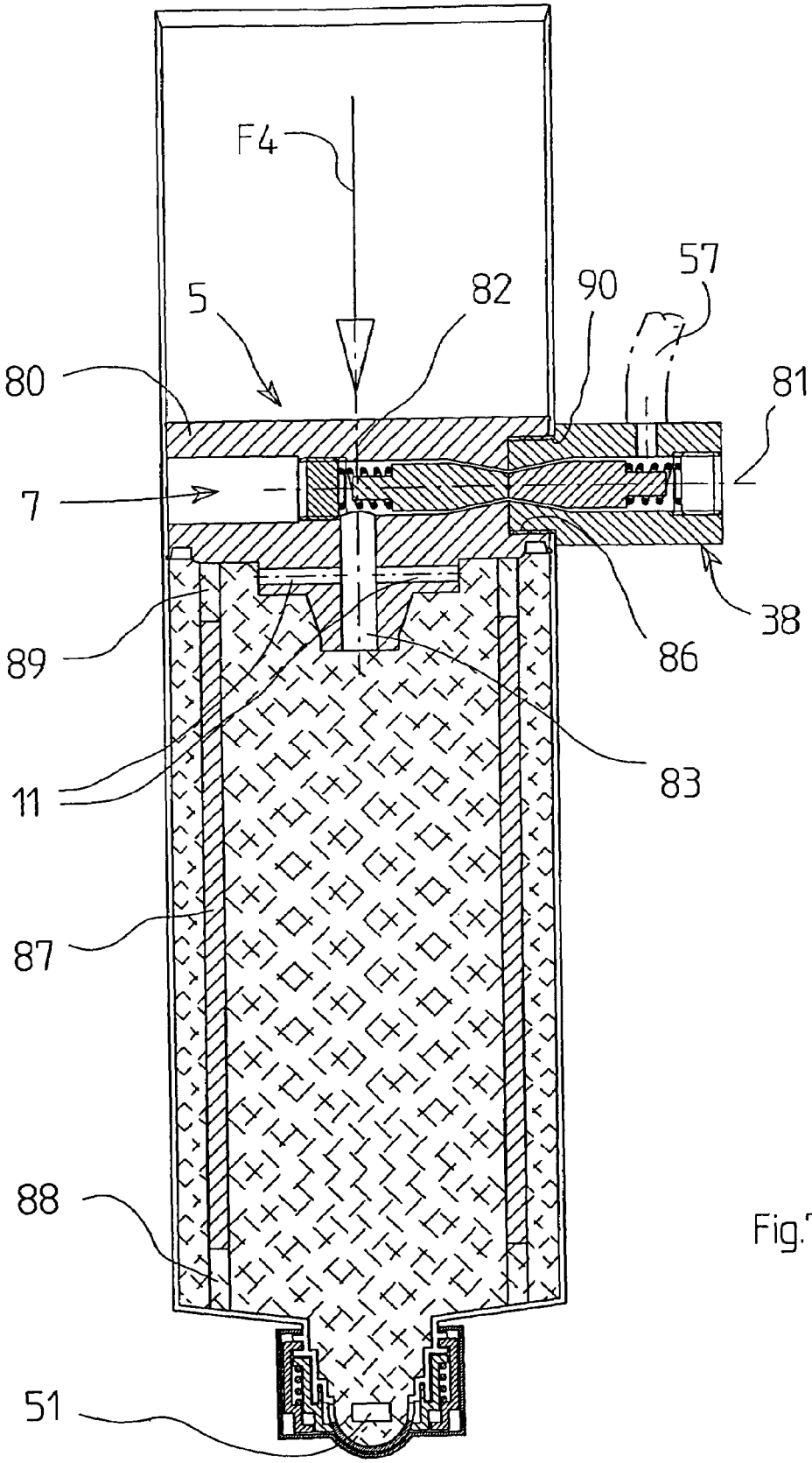
FIG. 7 shows a different embodiment of a piston of the invention applied to a cartridge.

Modifications and variants, in addition to those already described, are possible; for example, the piston of the invention can have the non-return valve 7 opening in correspondence with a lateral wall thereof (as shown in FIG. 7).

Hence in practice the piston 5 presents a thick part 80 in the interior of which the non-return valve 7 is inserted along an axis 81 substantially perpendicular to the cartridge axis 82.

In this embodiment, the non-return valve 7 again presents the holes 11 disposed at 90 degrees apart to distribute the ink uniformly within the cartridge and also presents a further hole 83 which discharges the ink along the cartridge axis 82.

Preferably, the thick part 80 presents a seat 86 to receive a portion of a non-return valve 38 positioned at the end of the tube 57 from the pump 35. Furthermore in this embodiment, a spacer 87 provided with apertures 88 and 89 to allow ink passage is advantageously inserted into the cartridge 1.

This embodiment of the device is particularly useful if large quantities of ink have to be fed without removing the cartridge 1 from the ink duct.

In this case, the piston 5 with the non-return valve disposed along the axis 82 is removed from the previously described cartridge and the spacer is inserted; the cartridge is then closed by the piston 5 provided with the non-return valve disposed along the axis 81 perpendicular to the axis 82 and a hole 90 is made in correspondence with the seat 86.

This enables the non-return valve 38 positioned at the end of the tube 57 to be inserted; this insertion causes the non-return valves 7 and 38 to open simultaneously, as already described.

Advantageously, the actuator cylinder, which during the operation of the previously described cartridge enables the ink to be discharged from the cartridge (not shown), is moved against the piston as indicated by the arrow F4, so that the piston remains locked (and at rest) between the said actuator cylinder and the spacer 87.

On operating the pump, the ink which arrives under pressure through the tube 57 passes through the valve 38 and the valve 7, enters the cartridge 1 through the holes 11, 83 and leaves the cartridge through the holes 51 to feed the ink duct with ink; during this process the piston 5 remains at rest.

Hence when a large quantity of the same ink is required, ink can be fed directly by the pump to the cartridge and from there to the ink duct.

It has been found in practice that the cartridge and the device of the invention are particularly advantageous in that they enable substantial ecological and economic advantages to be achieved.

Numerous modifications and variants can be applied to the cartridge for feeding ink to an ink duct of a printing machine and to the device for filling said cartridge conceived in this manner, all falling within the scope of the inventive concept; moreover all details can be replaced by technically equivalent elements. In practice the materials used and the dimensions can be chosen according to requirements and to the state of the art.

The invention claimed is:

1. A printing machine cartridge (1) for feeding ink to an ink duct of a printing machine comprising, for containing ink, a hollow casing (2) presenting a base (4) provided with an ink dispensing valve (4*a*) and a piston (5) slidable within said hollow casing (2) to cause the ink to be dispensed by said dispensing valve (4*a*), characterised in that said piston (5) presents a non-return valve (7) for feeding ink into said hollow casing (2), to enable the cartridge to be recharged, a chamber (6) defined between said hollow casing (2) and said base (4) and said piston (5), said ink being contained only in said chamber (6), and characterised by presenting second stiffening ribs (20) disposed on the periphery of said projecting annular edge (13) of said piston (5).

2. A cartridge (1) as claimed in claim 1, characterised in that said non-return valve (7) is positioned in a central position of a front wall (8) of said piston (5).

3. A cartridge (1) as claimed in claim 1, characterised in that said non-return valve (7) presents a portion (9) projecting from said front wall (8) of said piston (5).

4. A cartridge (1) as claimed in claim 1, characterised in that said non-return valve (7) comprises a valve body (10) integral with said piston (5).

5. A cartridge (1) as claimed in claim 1, characterised in that said non-return valve (7) comprises, in correspondence with a portion of said piston (5) facing the interior of said hollow casing (2), a plurality of holes (11) for distributing ink uniformly within said hollow casing (2).

6. A cartridge (1) as claimed in claim 1, characterised in that said piston (5) presents an annular edge (13) projecting beyond said projecting portion (9) of said non-return valve (7).

7. A cartridge (1) as claimed in claim 1, characterised in that said piston (5) presents one or more first stiffening ribs (15) disposed on said front wall (8).

8. A cartridge (1) as claimed in claim 1, characterised in that said piston (5) presents at least one first scraper (16) to remove ink from the inner wall of said hollow casing (2) when said piston (5) penetrates into the hollow casing (2) during ink dispensing, and at least one second scraper (17) to remove ink from the inner wall of said hollow casing (2) when said piston 5 moves from the interior of the hollow casing (2) towards an aperture (18) thereof, during ink recharging.

9. A device (30) for filling a cartridge (1) feeding ink to an ink duct of a printing machine, comprising a housing (32) for said cartridge and a filling head (33) supported by actuator means (34) for its movement and connected to an ink feed pump (35), said filling head (33) presenting at least one opening element (37) for opening a non-return valve (7) of a piston (5) of a cartridge (1) when said filling head (33) is associated with said piston (5), such as to deliver ink into said cartridge (1).

10. A filling device (30) as claimed in claim 9, characterised in that said filling head (33) presents a non-return valve (38) positioned in a region of said filling head (33) which defines the hydraulic connection with a piston (5) of an ink cartridge (1) to be filled.

11. A filling device (30) as claimed in claim 9, characterised in that said non-return valve (38) is positioned in a central position of a wall (40) of the filling head (33).

12. A filling device (30) as claimed in claim 9, characterised in that a valving element (41) of said filling head (33) presents, when the non-return valve is closed, a projecting end defining said opening element (37) for the non-return valve (38).

13. A filling device (30) as claimed in claim 9, characterised in that said filling head (33) comprises a part (44) supporting said non-return valve (38) and a cap (45) which, together with said part (44), defines an inner chamber (46) of the filling head (33) into which a conduit (47) connected to said ink pump (35) and one or more through holes 48 connecting the non-return valve (38) to the internal chamber (46) of the filling head (33) open.

14. A filling device (30) as claimed in claim 9, characterised in that said cap (45) is connected to the end of a rod (45) of a pneumatic piston forming said actuator (34).

15. A filling device (30) as claimed in claim 9, characterised by presenting a sensor (49) for measuring the extension of said rod (50) of an operating cylinder (34) for said filling head (30), to determine the exact ink level in the cartridge and to automatically interrupt the recharging when the desired quantity is reached or when the cartridge is full.

16. A filling device (30) as claimed in claim 9, characterised in that said pump comprises a first chamber (61) provided with an end part (68) of increased diameter within which a collection disc (63) is slidable, between said end part (68) of increased diameter and said collection disc there being defined an annular ink passage channel, so that the ink enters said first chamber (61) through said annular channel, is pressurized by said collection disc (63) which moves within said first chamber, and emerges from said first chamber through an aperture (71).

17. A filling device (30) as claimed in claim 16, characterised by comprising a delivery chamber connected to the first chamber via a non-return valve which enables the ink to pass from the first chamber to the delivery chamber, where a rod of the pneumatic cylinder presents portions of different cross-sections and passes through both said first chamber and said delivery chamber, such that the collection disc compresses the ink in making it pass from the first chamber to the delivery chamber, in the delivery chamber the ink pressure being further increased when a rod portion of greater cross-section enters the delivery chamber, to cause the ink to emerge at high pressure through said aperture (71) which is positioned in said delivery chamber.

18. A cartridge (1) for feeding ink to an ink duct of a printing machine comprising, for containing ink, a hollow casing (2) presenting a base (4) provided with an ink dispensing valve (4*a*) and a piston (5) slidable within said hollow casing (2) to cause the ink to be dispensed by said dispensing valve (4*a*), characterised in that said piston (5) presents a non-return valve (7) for feeding ink into said hollow casing (2), to enable the cartridge to be recharged, wherein said dispensing valve (4*a*) comprises a central part (50*a*)carrying at least one hole (51) for ink exit from said cartridge, said hole (51) being closable by an internal ring (53) slidably connected to said central part (50*a*)against an elastic spring (54) locked by an outer ring (52) rigid with said central part (50*a*).

19. A piston (5) of a cartridge (1) for feeding ink to an ink duct of a printing machine, characterised by presenting a non-return valve (7), to enable a cartridge carrying said piston to be recharged, wherein said non-return valve (7) opens in correspondence with a side wall thereof, and further comprising a seat (86) to receive a portion of a non-return valve (38) located at the end of a tube (57) originating from a pump (35).

20. A printing machine cartridge (1) for feeding ink to an ink duct of a printing machine comprising, for containing ink, a hollow casing (2) presenting a base (4) provided with an ink dispensing valve (4*a*) and a piston (5) slidable within said hollow casing (2) to cause the ink to be dispensed by said dispensing valve (4*a*), characterised in that said piston (5) presents a non-return valve (7) for feeding ink into said hollow casing (2), to enable the cartridge to be recharged, a chamber (6) defined between said hollow casing (2) and said base (4) and said piston (5), said ink being contained only in said chamber (6), wherein said piston freely floats in said hollow casing (2).

* * * * *

UNITED STATES PATENT AND TRADEMARK OFFICE

CERTIFICATE OF CORRECTION

PATENT NO. : 7,614,728 B2
APPLICATION NO. : 11/119753
DATED : November 10, 2009
INVENTOR(S) : Ghisalberti et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 783 days.

Signed and Sealed this

Nineteenth Day of October, 2010

David J. Kappos

David J. Kappos
*Director of the United States Patent and Trademark Office*